US006763770B2

(12) United States Patent
Marrujo

(10) Patent No.: US 6,763,770 B2
(45) Date of Patent: Jul. 20, 2004

(54) FOLDING PORTABLE TABLE

(76) Inventor: John Marrujo, 1834 Crenshaw St., San Diego, CA (US) 92105

( * ) Notice: Subject to any disclaimer, the term of this patent is extended or adjusted under 35 U.S.C. 154(b) by 0 days.

(21) Appl. No.: 10/138,462

(22) Filed: May 3, 2002

(65) Prior Publication Data

US 2003/0205178 A1 Nov. 6, 2003

(51) Int. Cl.[7] ..... A47B 3/00
(52) U.S. Cl. ..... 108/115; 108/132
(58) Field of Search ..... 108/99, 106, 176, 108/132, 130, 115

(56) References Cited

U.S. PATENT DOCUMENTS

| | | | |
|---|---|---|---|
| 830,532 | A | 11/1906 | Rozee |
| 848,991 | A | 4/1907 | Harvey |
| 1,833,177 | A | 11/1931 | Rice |
| 2,938,832 | A | 5/1960 | Mondineu |
| 3,661,100 | A | 5/1972 | Tennant |
| 3,845,728 | A | 11/1974 | Piretti |
| 5,865,129 | A | 2/1999 | Samples |
| D449,184 | S | 10/2001 | Cain |

FOREIGN PATENT DOCUMENTS

| | | | | |
|---|---|---|---|---|
| AU | 280717 | * | 7/1964 | ..... 108/90 |
| GB | 286326 | * | 3/1928 | ..... 108/176 |

* cited by examiner

*Primary Examiner*—Jose V. Chen
(74) *Attorney, Agent, or Firm*—Gary L. Eastman

(57) ABSTRACT

A folding portable table includes an upper table surface, a number of folding table legs, and a lower table surface held between the legs by pins protruding from the perimeter of the lower table surface and slidably retained in grooves in the legs. The pins slide up and down in the grooves, allowing the lower table surface to be raised up to, or lowered down from, the upper table surface. When the lower table surface is raised up adjacent to the upper table surface, the legs can be folded under the upper table surface for transport and storage of the table. The table can be deployed by unfolding the legs and lowering the lower table surface down from the upper table surface. The grooves may be tapered from top to bottom such that the pins are frictionally bound in the deployed position in order to make the table stronger.

20 Claims, 5 Drawing Sheets

FOLDING PORTABLE TABLE

FIELD OF THE INVENTION

The present invention relates generally to furniture. The present invention relates more particularly, though not exclusively, to a folding portable table having a storage shelf.

BACKGROUND OF THE INVENTION

There have been a number of folding and portable tables in existence for a number of years. For example, one type of folding table described in U.S. Pat. No. 3,661,100 has a table surface, four support legs, and a central leg brace attached to the support legs by sleeves which slide up and down the legs such that the central leg brace can be raised up to the table surface and the legs can be folded under the table surface for storage. Another type of foldable table described in U.S. Pat. No. 1,833,177 has rods that extend between the legs to support a lower shelf. A third type described in U.S. Pat. No. 830,532 is a convertible table with a table top vertically adjustable by means of holes in the table top and sleeves on the bottom of the table top through which the legs slide up and down. A fourth type described in U.S. Pat. No. 2,938,632 is a table with vertically adjustable upper and lower table tops supported by tubes and rods which surround and slide up and down support legs which can be folded with the table tops for storage. There are many other types of tables variously including a table surface and folding legs, and a table with upper and lower table surfaces supported between the legs.

Currently available folding tables that have an upper table surface and a lower table surface include a cumbersome mechanism for raising the lower table surface to the upper table surface, such as a sleeve surrounding the legs. This sleeve surrounding the legs can hinder their movement or require additional mechanisms to facilitate the opening and closing of the table legs. Thus there is a need for a table where the leg-folding mechanism does not hinder movement of the legs.

It is an object of the present invention to provide a foldable portable table that has an upper table surface, folding legs, and a lower table surface supported between the legs and which allows the lower table surface to be raised up to the upper table surface such that the legs can be folded under the upper table surface, with little or no hindrance of the movement of the legs. It is another object of the present invention to provide such a table that be sturdy enough to be used as a bench by two adult persons simultaneously; yet lightweight, compact and simple enough to be handled by one person without assistance of another person. It is yet another object of the present invention to provide such a table at a relatively low cost.

SUMMARY OF THE INVENTION

The present invention is a folding portable table having an upper table surface, four folding support legs each having a lengthwise groove formed in a side of the leg facing the space between the legs, and a lower table surface supported by four pins each protruding from the lower table surface into each of the grooves in the legs. The grooves are tapered from top to bottom so that when the lower table surface is in the lowered position, the grooves releasably frictionally bind the pins to strengthen the table. Each pin slides up and down in its groove simultaneously with the other pins such that the lower table surface can be easily raised up adjacent to the upper table surface. The legs can then be folded under the upper table surface for transport and storage of the table.

BRIEF DESCRIPTION OF THE DRAWINGS

The novel features of this invention, as well as the invention itself, both as to its structure and its operation, will be best understood from the accompanying drawings, taken in conjunction with the accompanying description, in which similar reference characters refer to similar parts, and in which.

DETAILED DESCRIPTION OF A PREFERRED EMBODIMENT

Figure 1:
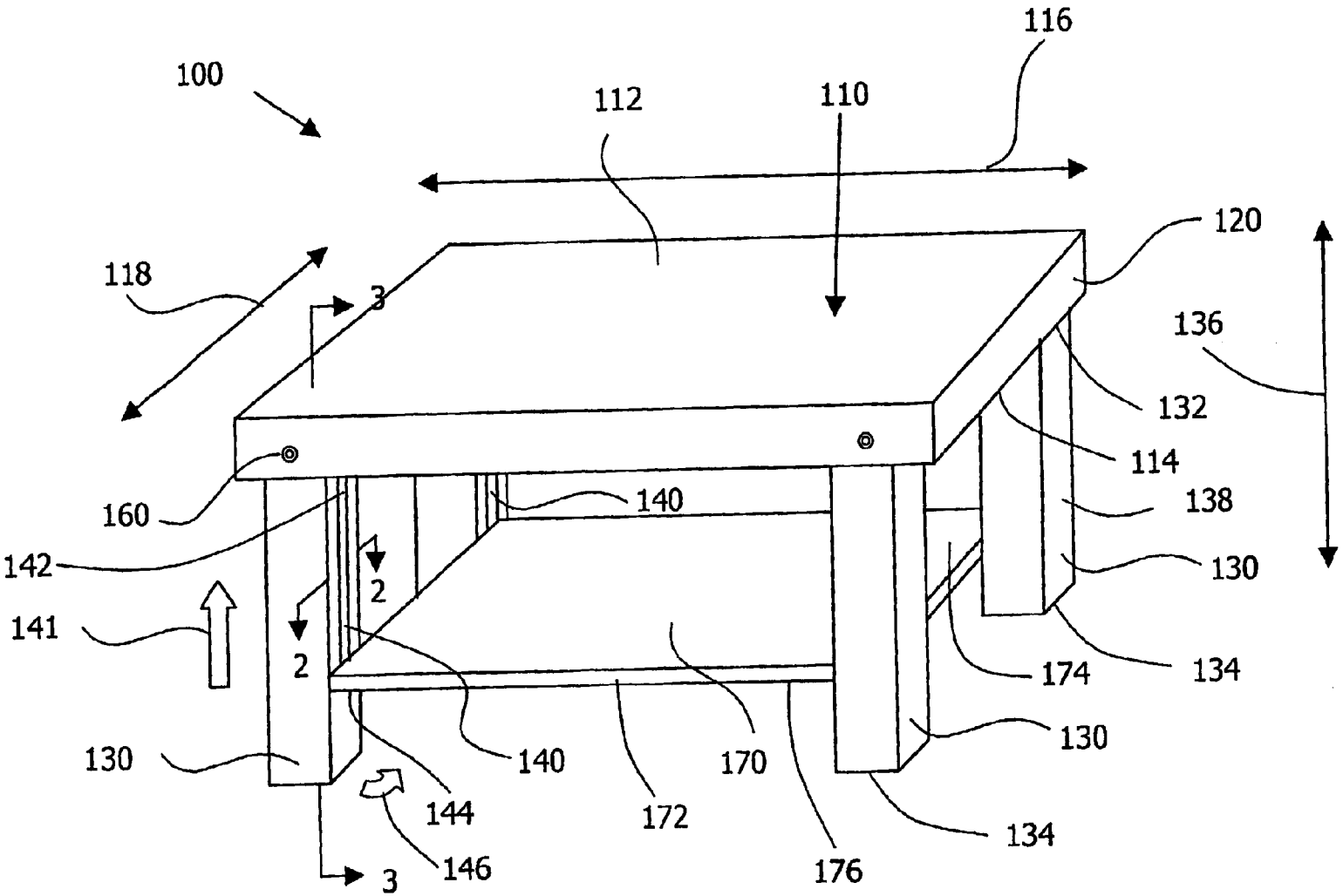
FIG. 1 is a perspective view of the Folding Portable Table of the present invention.

A preferred embodiment of the Folding Portable Table of the present invention is shown in FIG. 1 and generally designated 100. Table 100 has an upper table surface (or upper surface) 110; legs 130 formed with longitudinal grooves 140. Legs 130 may be secured to table 100 with bolts 160, and support a lower table surface (or lower surface) 170.

Upper surface 110 has a top side 112, a bottom side 114, an upper length 116, an upper width 118, and an upper perimeter 120. Bottom side 114 may be substantially planar. Alternatively, bottom side 114 may be of other shapes. Top side 112 may be substantially planar as shown in FIG. 1. Alternatively, top side 112 may be of other shapes. Upper surface 110 is shown as substantially rectangular. However, upper surface 110 can also have other polygonal or other angular shapes, or it can be round, or partly round and partly angular (or "angular/round"). Upper surface 110 can also have rounded vertices. In a preferred embodiment, upper length 116 may be about thirty (30) inches, however, it is to be appreciated that this length may vary. Similarly, in a preferred embodiment, upper width 118 may be about fifteen (15) inches, but it too may vary. Upper surface 110 may be made of polymer, wood, metal, Fiberglass, ceramic, or any other material having comparable strength.

Legs 130 are foldable under upper surface 110. FIG. 1 shows four (4) legs 130. However, table 100 can also have three (3), five (5), or as many more legs 130 as desired. Each leg 130 has a leg top 132, a foot 134, a leg length 136, and a leg surface 138. Each leg 130 may be pivotally attached at leg top 132 to bottom side 114 of upper surface 110 by bolt 160. Each leg may be pivotally attached using hinges, pins, axles, or pegs, or any other functionally equivalent structures known in the art.

Each leg 130 pivots in directions 146 about its bolt 160 between an extended position and a folded position. Legs 130 are shown in FIG. 1 in extended position. In the extended position, leg 130 may be substantially perpendicular to bottom side 114. In its folded position, leg 130 may be substantially parallel to bottom side 114. Upper surface 110 may be formed to allow one or more legs 130 in folded position to recess into upper surface 110.

Each leg 130 is shown as rectangularly prismatic, however, each leg 130 may be of another angular or round shape or may be partly angular and partly round. Each leg 130 may also have rounded vertices. Legs 130 may be made of polymer. Alternatively, legs 130 may be made of wood, metal, ceramic, Fiberglass, or any other material having comparable strength.

Each leg 130 is formed with a groove 140 having a groove top 142 and a groove bottom 144. Groove 140 may extend from leg 130 into upper surface 110 such that groove top 142 be in a portion of upper surface 110 adjacent leg top 132, and such that groove 140 be continuous from leg 130 to upper surface 110 when leg 130 is in extended position. Alternatively, groove top 142 may be in leg 130, at or adjacent leg top 132. Groove bottom 144 may be at or adjacent foot 134. Alternatively, groove bottom 144 can be at any other point between groove top 142 and foot 134.

Groove 140 extends from groove top 142 to groove bottom 144, and is substantially parallel to leg 130. In a preferred embodiment, the length of groove 140 intersects a portion of leg surface 138 facing space between any two legs 130. Inside each leg 130, a portion of groove 140 distal from leg surface 138 is wider than a portion of groove 140 proximal to leg surface 138.

Lower surface 170 has a lower perimeter 172, an upward side 174 and a downward side 176. Upward side 174 may be substantially planar. Alternatively, upward side 174 may have another angular/round shape. Downward side 176 may also be substantially planar. Alternatively, downward side 176 may have another angular/round shape. Lower surface 110 is shown as substantially rectangular, however, it could be formed to have other polygonal or other angular shapes, or it can be round, or partly round and partly angular.

Lower surface 170 is supported between legs 130 such that upward side 174 is substantially parallel to bottom side 114 of upper surface 110. Alternatively, upward side 174 may be at an angle to bottom side 114 of upper surface 110. In a preferred embodiment, lower surface 170 may be made of polymer. Alternatively, lower surface 170 may be made of wood, metal, polymer, Fiberglass, ceramic, or any other material having comparable strength. The lower surface may be slidably raised up adjacent to upper surface 110, and to be lowered down from upper surface 110, between legs 130. Upper surface 110 may be formed to allow lower surface 170 to recess into upper surface 110.

Figure 2:
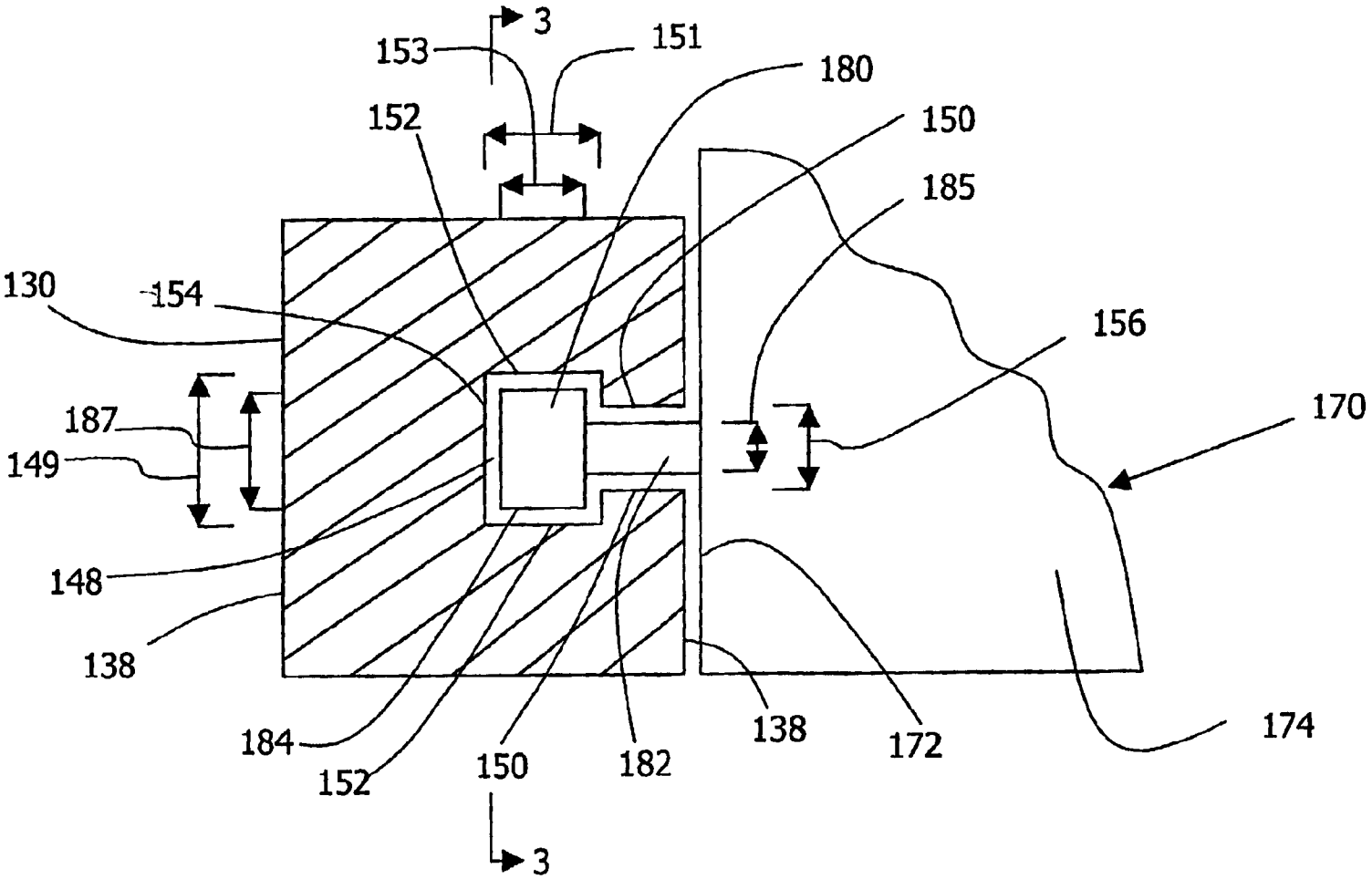
FIG. 2 is a transverse cross-sectional view of a leg of the Folding Portable Table of the present invention taken across line 2—2 in FIG. 1, showing a pin in a T-shaped groove in the leg.

FIG. 2 is a cross-sectional view of a leg 130 taken along line 2—2 in FIG. 1, showing a pin 180 slidably retained in its groove 140. Each of pins 180 has a shaft 182 and a pin head 184. For each pin 180, pin head 184 is at least partially wider than shaft 182. Pins 180 may be made of metal. Alternatively, pins 180 may be made of wood, polymer, Fiberglass, ceramic, or any other material having comparable strength. Each of pins 180 extends from lower perimeter 172 of lower surface 170, adjacent a unique groove 140, with pin head 184 distal from lower surface 170 and received in adjacent groove 140.

While pins 180 are shown as extending from lower perimeter 172 of lower surface 170, any of pins 180 can also extend from any other part of lower surface 170, for example, from downward side 176 or from upward side 174. Inside each leg 130, pin head 184 is retained in a wider portion of groove 140 distal from leg surface 138, by a narrower portion of groove 140 proximal to leg surface 138. In FIG. 2, a cross-section of groove 140 is shown as substantially T-shaped.

In this configuration, groove 140 has inner channel 148 and lips 150. Inner channel 148 has a width 149 that is wider than the distance 156 between lips 150, and a depth 151 that is wider than the thickness 153 of pin 180. Inner channel 148 has channel sides 152 and channel back 154. Shaft 182 of each pin 180 extends from lower perimeter 172 into groove 140. Pin head 184 is retained in inner channel 148 by lips 150. A distance 156 between lips 150 may be wider than the diameter 185 of shaft 182 and narrower than the diameter 187 of head 184. Each pin 180 slides up and down in direction 141 within its groove 140 along the length of groove 140. Lower surface 170 can be raised up to, or lowered down from, upper surface 110 sliding pins 180 up or down in their grooves 140. If groove top 142 is in upper surface 110, then each of pins 180 may recess into upper surface 110 when lower surface 170 is raised up to upper surface 110.

In FIG. 2, pin head 184 is shown as cylindrical. Pin head 184 may alternatively be frustoconical or spherical, or have another angular/round shape. While groove 140 is shown as substantially T-shaped, a cross-section of groove 140 may also be trapezoidally shaped or circularly shaped, or may have another angular or round shape, or may be partly angular and partly round.

Figure 3:
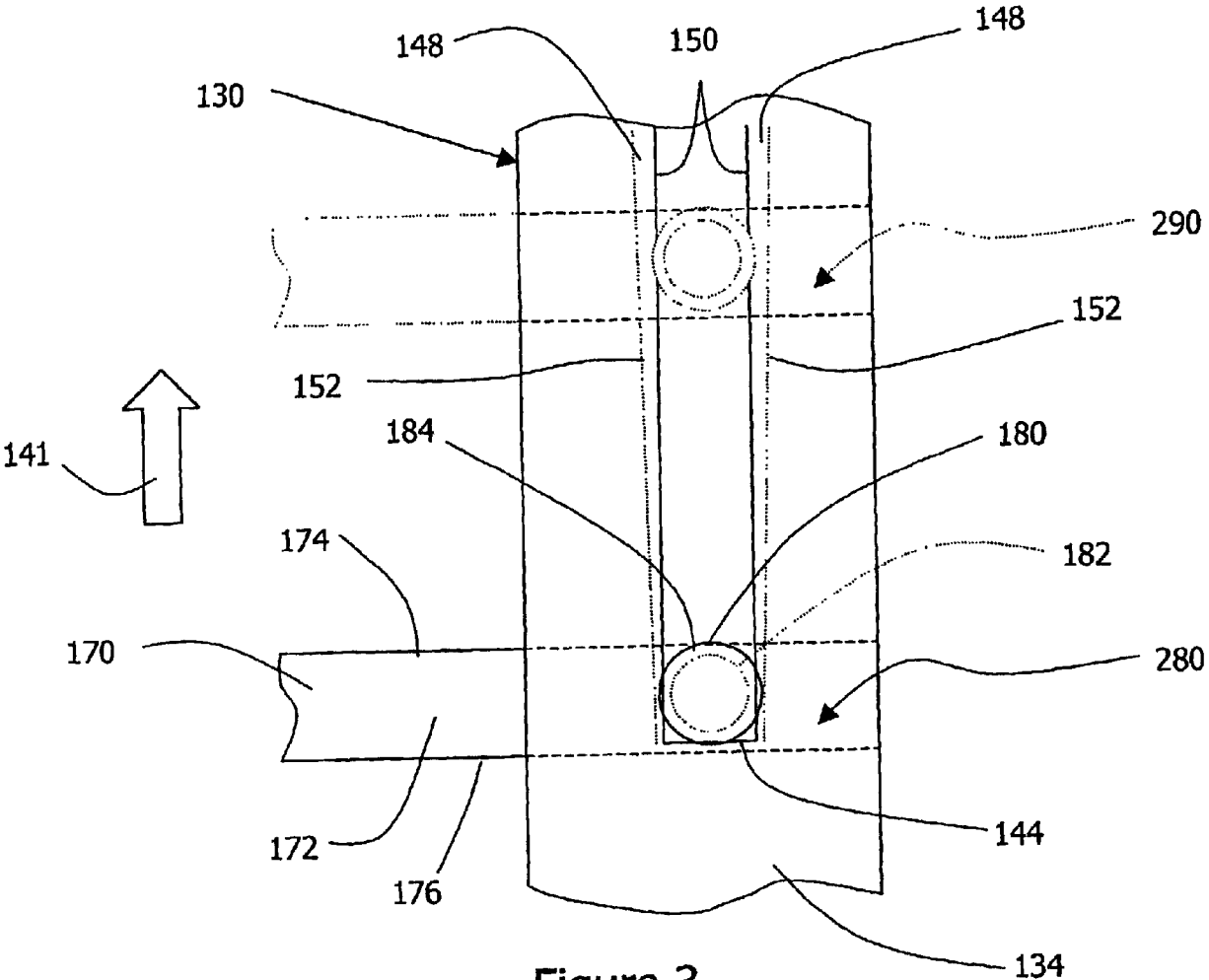
FIG. 3 is a lengthwise cross-sectional view of a leg of the Folding Portable Table of the present invention taken across line 3—3 in FIGS. 1 and 2, showing the taper of the groove.

Referring now to FIG. 3, a cross-sectional view of a leg 130 taken along line 3—3 in FIG. 1 is shown and depicts lower table surface 170 in a first position 280 and a second position 290 where pin 180 slides within groove 140. Channel sides 152 are shown as tapering or slanting inwards from groove top 142 (not shown) to groove bottom 144 in leg 130. Alternatively, channel sides 152 may be substantially parallel. As another alternative, one channel side 152 may slant inwards while the other channel side 152 remains substantially parallel to leg length 136.

FIG. 3 also shows pin 180 in two positions, a deployed position 280 and an intermediate position 290 (shown in dashed lines). Deployed position 280 may be at or near groove bottom 144. When pin 180 is in deployed position 280, and at least one of channel sides 152 slants inwards, pin head 184 may be releasably bound by channel sides 152. The releasable binding may be frictional. Intermediate position 290 is in groove 140 between deployed position 280 and groove top 142. In intermediate position 290, pin head 184 can freely slide up and down in inner channel 148 between deployed position 280 and groove top 142.

When pin 180 is in deployed position 280, the binding of pin head 184 between channel sides 152 provides structural strength to table 100. The sliding up and down of pins 290 in grooves 140 allows lower surface 170 to be raised up adjacent to bottom side 114, so that legs 130 can be folded under upper surface 110 by pivoting each leg 130 about its bolt 160 to folded position. In folded position, legs 130 may be substantially parallel to bottom side 114.

Referring back to FIG. 2, channel back 154 and the inner portions of lips 150 facing channel back 154, are substantially parallel to each other. Alternatively, any or all of channel back 154 and the inner portions of lips 150 facing channel back 154, may taper or slant inwards from groove top 142 to groove bottom 144. This can further strengthen table 100 when pins 180 are in deployed position 280. As shown in FIG. 2, the surfaces of lips 150 facing each other are parallel to each other. Alternatively, the surfaces of lips 150 facing each other may converge inwards from groove top 142 to groove bottom 144. This can also further strengthen table 100 when pins 180 are in deployed position 280.

Figure 4:
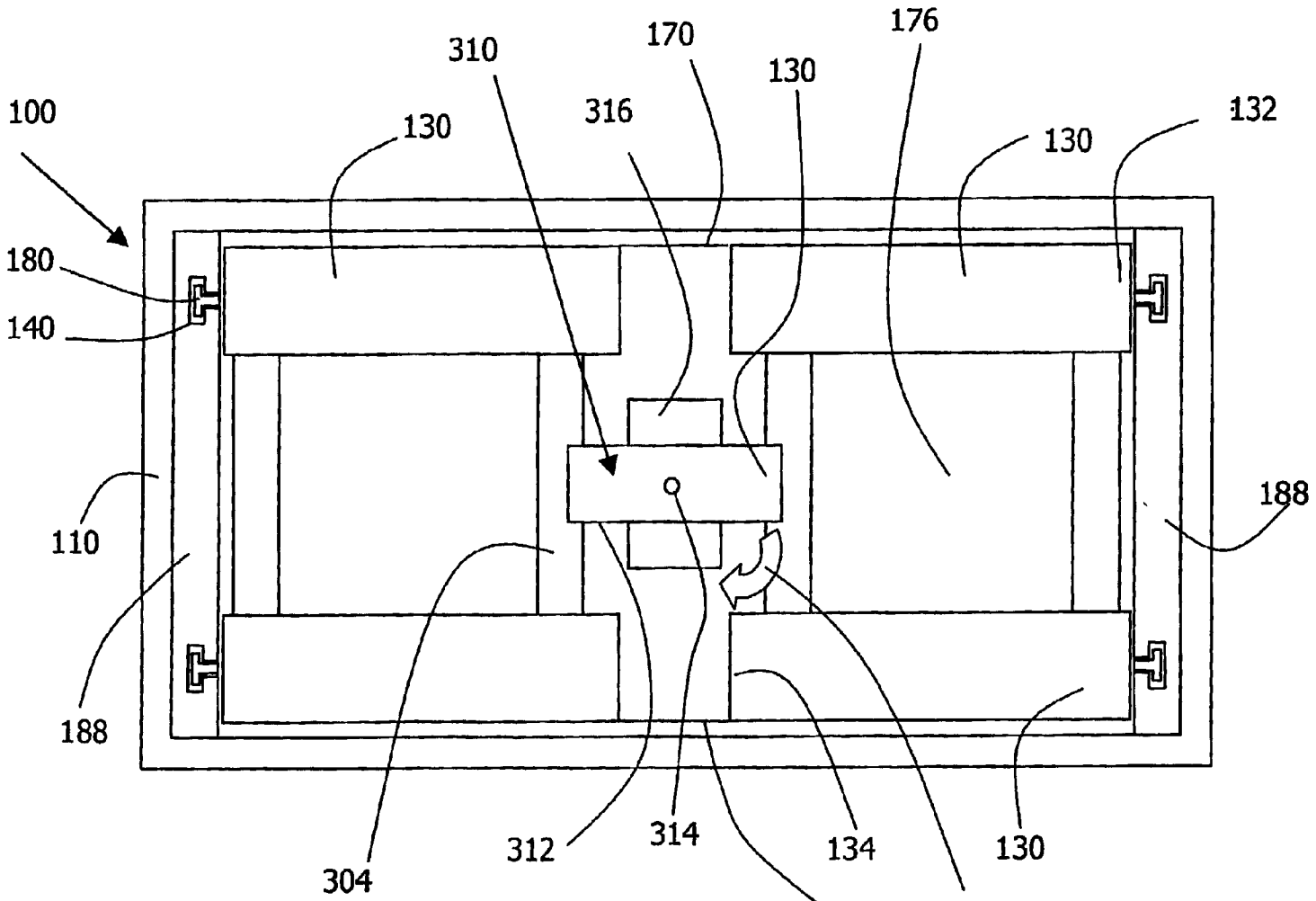
FIG. 4 is a bottom view of the Folding Portable Table of the present invention in a folded, or storage and transport, configuration.

Referring now to FIG. 4, a bottom view of the Folding Portable Table 100 of the present invention is shown in a folded configuration. In the folded configuration, lower surface 170 and legs 130 may recess into upper surface 110. Folding Portable Table 100 may also include optional cross pieces 304 to extend between each of two pairs of legs 130, for added strength.

Table 100 may also include a device for securing lower table surface 170 and legs 130 in folded position beneath upper table surface 110. One such device may include one or more locks 310, or other fastening devices such as latches, ties, hooks, pins, etc. In a preferred embodiment, each lock 310 may include a bar 312 rotatably attached to an axle 314 fixed to a block 316 attached to downward side 176. Bar 312 may be rotated in direction 313 so that an end of bar 312 is over at least one cross piece 304, thus holding legs 130 in a folded position. As an alternative, means for securing may include more than one lock 310. As another alternative, each bar 312 may cover one or more legs 130 instead of one or more cross pieces 304. While lock 310 is shown as attached to the middle of downward side 176 of lower surface 170, its position may vary without departing from the present invention.

In FIG. 4, lower table surface 170 is shown as held adjacent to upper table surface 110 by legs 310 in folded position. Legs 310 may alternatively fold beside lower surface 170, and lower surface 170 may be held adjacent to upper surface 110 independent of legs 130. Each lock 310 may be made of polymer. Alternatively, each lock 310 may be made of wood, metal, Fiberglass, ceramic, or any other material having comparable strength.

In its folded position, lower surface 170 may be stored immediately adjacent upper surface 110 by including a block 188 attached to the underside of upper surface 110 that is forming with a groove 140 to receive pins 180. In this embodiment, lower surface 170 may be secured in place, and then legs 130 may be pivoted to their collapsed position.

From a folded position, table 100 may be deployed by pivoting legs 130 to this extended position, and allowing lower surface 170 to drop downward in direction opposite direction 141 whereby pins 180 slide down grooves 140 to a deployed position 280. When deployed, table 100 stands sturdily and can support at least two adult persons sitting on top side 112, while upward side 172 of lower surface 170 provides a place to stow gear.

Figure 6:
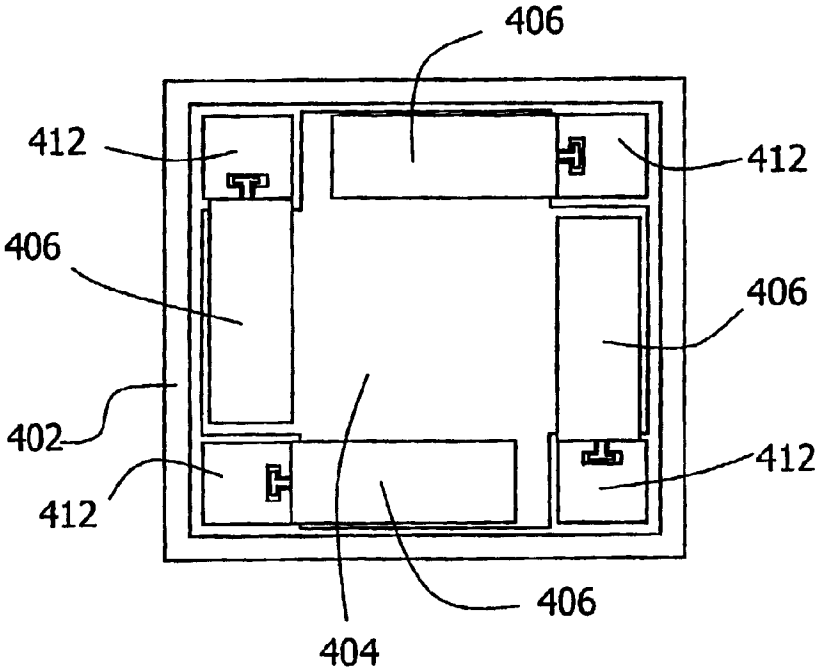
FIGS. 5 and 6 are bottom view of an alternative embodiment of the Folding Portable Table of present invention showing a design where four legs each fold in a different direction, resulting in a table that is easy to set up and take down.
Figure 5:
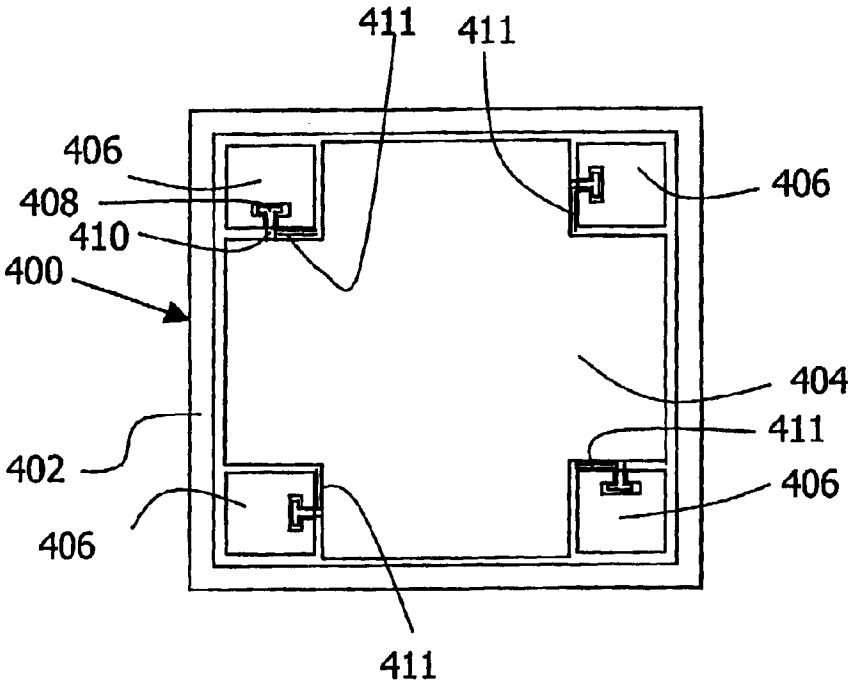

Referring now to FIGS. 5 and 6, an alternative embodiment of the present invention is shown and generally designated 400. Table 400 has an upper table surface 402 and a lower table surface 404 that is supported between four (4) legs 406 hingedly extending form the upper table surface 402. Each leg 406 is formed with a groove 408 to receive a pin 410 that is slidable within the groove 408 so that lower table surface 404 may be positioned apart from the upper table surface as discussed above.

Hinges 411 attach legs 406 to upper table surface 402 and provide for a first configuration wherein legs 406 extend substantially perpendicularly from upper table surface 402 and the lower table surface 404 is apart from the upper table surface, and a second configuration wherein the lower table surface 404 is adjacent the upper table surface 402 and legs 406 are hingedly folded at hinges 411 to be parallel to upper table surface 402.

Each leg 406 may pivot in a plane parallel to one or more planes in which one or more other legs 406 pivot. Alternatively, each leg 406 may pivot in a plane perpendicular to one or more planes in which one or more other legs 406 pivot.

Folding Portable Table 400 is shown to have a substantially square upper table surface 402, however, alternative shapes could be used. Further, the placement of hinges 411 on the same side of legs 406 as grooves 408 is merely for exemplary purposes, and it is to be appreciated that hinges 411 could be on the other inward-facing surface of leg 406, without departing from the present invention.

While the particular Folding Portable Table as herein shown and disclosed in detail is fully capable of obtaining the objects and providing the advantages herein before stated, it is to be understood that it is merely illustrative of the presently preferred embodiments of the invention and that no limitations are intended to the details of construction or design herein shown other than as described in the appended claims.

I claim:

1. A folding portable table comprising:

an upper surface;

a plurality of legs, each of said plurality of legs pivotably extendable from said upper surface and formed with a longitudinal groove;

a lower surface having a plurality of pins, each said pin of said plurality of pins slidably retained in one said longitudinal groove wherein said folding portable table is configurable from a first configuration wherein said plurality of legs are substantially perpendicular to said upper surface and said lower surface is apart from said upper surface, and a second configuration wherein said lower surface is adjacent said upper surface and said legs are substantially parallel to said upper surface;

each of said plurality of legs further comprises a leg surface;

each of said plurality of grooves intersects a portion of said leg surface substantially facing space between at least two of said plurality of legs, each of said plurality of grooves further comprising a wider portion distal from said leg surface and a narrower portion proximal to said leg surface; and each of said plurality of pins comprises a shaft and a pin head, each said pin head at least partially wider than said shaft, said shaft of each of said plurality of pins extending from said lower surface into said adjacent of said plurality of grooves, each said pin head retained in each said wider portion by each said narrower portion.

2. A folding portable table as in claim 1, wherein said plurality of legs in said second configuration retain said lower surface adjacent said upper surface.

3. A folding portable table as in claim 1, wherein said longitudinal groove has a T-shaped cross-section.

4. A folding portable table as in claim 1, wherein at least one of said upper surface, said lower surface, and said plurality of legs comprises polymer.

5. A folding portable table as in claim 1, wherein at least one of said upper surface, said lower surface, and said plurality of legs comprises metal.

6. A folding portable table as in claim 1, wherein at least one of said upper surface, said lower surface, and said plurality of legs comprises wood.

7. A folding portable table as in claim 1, wherein said upper surface is substantially planar.

8. A folding portable table as in claim 1, wherein said lower surface is substantially rectangular.

9. A folding portable table as in claim 1, further comprising at least one cross bar between at least one pair of said plurality of legs.

10. A folding portable table comprising:

an upper surface;

a plurality of legs, each of said plurality of legs having a leg length and formed with a longitudinal groove;

a means for pivotally attaching each of said plurality of legs to said upper surface, wherein each of said plurality of legs can be pivoted between an extended position substantially perpendicular to said upper surface, and a folded position substantially parallel to said upper surface;

a lower surface;

a plurality of pins extending from said lower surface, one pin of said plurality of pins positioned within said longitudinal groove and slidable therein;

each of said plurality of legs further comprises a lea surface;

each of said longitudinal grooves intersects a portion of said leg surface substantially facing space between at least two of said plurality of legs, each of said longitudinal grooves further comprising a wider portion distal from said leg surface and a narrower portion proximal to said leg surface;

each of said plurality of pins comprises a shaft and a pin head, each said pin head at least partially wider than said shaft, said shaft of each of said plurality of pins extending from said lower surface into said adjacent of said longitudinal grooves, each said pin head retained in each said wider portion by each said narrower portion; and wherein said lower surface is apart from said upper surface when said plurality of legs is in said extended position, and said lower surface is adjacent said upper surface when said plurality of legs is in said folded position.

11. A folding portable table as in claim 10, wherein each said wider portion comprises an inner channel comprising channel sides, wherein at least one of said channel sides slants inwards from said groove top to said groove bottom, and wherein each said pin head is releasably bound by said channel sides when each said leg is in said extended position.

12. A folding portable table as in claim 10, wherein a cross-section of said longitudinal groove is substantially T-shaped.

13. A folding portable table as in claim 10 wherein each said pin is cylindrical.

14. A folding portable table as in claim 10, wherein each of said plurality of grooves further comprises a groove top and a groove bottom, wherein each of said plurality of grooves extends from said groove top to said groove bottom substantially parallel to said leg; and wherein each of said plurality of pins can slide up and down between said groove top and said groove bottom.

15. A folding portable table as in claim 10, wherein:

each of said plurality of grooves extends from each of said plurality of legs into said upper surface, wherein said groove top is in said upper surface, wherein each of said plurality of grooves is continuous from each of said plurality of legs into said upper surface when each of said plurality of legs is in said extended position.

16. A folding portable table as in claim 10, wherein said lower surface further comprises a perimeter, wherein each of said plurality of pins extends from said perimeter.

17. A folding portable table as in claim 10, wherein said means for pivotally attaching further comprises a bolt.

18. A folding portable table as in claim 10, further comprising a means for securing said plurality of legs in said folded position.

19. A folding portable table as in claim 18, wherein said means for securing said plurality of legs comprises a lock.

20. A folding portable table as in claim 10, wherein:

at least one of said lower surface, said plurality of legs, and said plurality of pins, can recess into said upper surface.

* * * * *